US006628085B2

(12) United States Patent
Yang

(10) Patent No.: US 6,628,085 B2
(45) Date of Patent: Sep. 30, 2003

(54) LIMIT VOLTAGE CIRCUIT USING LIGHT EMITTING DIODES AS THERMAL-LOSS REDUCING IMPEDANCES, ESPECIALLY FOR MATCHING A SATURATION VOLTAGE OF RECHARGEABLE CELLS DURING CHARGING

(76) Inventor: Tai-Her Yang, No. 59, Chung Hsing 8 St., Si-Hu Town, Dzan-Hwa (TW)

( * ) Notice: Subject to any disclaimer, the term of this patent is extended or adjusted under 35 U.S.C. 154(b) by 123 days.

(21) Appl. No.: 09/791,825

(22) Filed: Feb. 26, 2001

(65) Prior Publication Data

US 2002/0117975 A1 Aug. 29, 2002

(51) Int. Cl.[7] ..... H05B 37/00
(52) U.S. Cl. ..... 315/169.3; 315/291; 315/200 R
(58) Field of Search ..... 315/291, 307, 315/224, 169.3, 200 R

(56) References Cited

U.S. PATENT DOCUMENTS 6,320,330 B1 * 11/2001 Haavisto et al. ..... 315/291

* cited by examiner

*Primary Examiner*—David Vu
(74) *Attorney, Agent, or Firm*—Bacon & Thomas, PLLC

(57) ABSTRACT

A variable resistance limit voltage circuit system for application to various types of circuit uses light emitting diodes as impedances to limit thermal losses as well as to provide display functions. The system is particularly suitable for use in a charging circuit for a rechargeable cell, ensuring fully saturated charging of the rechargeable cell while preventing the rechargeable cell from being damaged by overcharging, reducing thermal loss in the limit voltage circuit, and providing a light emitting display of charging status as required.

23 Claims, 9 Drawing Sheets

LIMIT VOLTAGE CIRCUIT USING LIGHT EMITTING DIODES AS THERMAL-LOSS REDUCING IMPEDANCES, ESPECIALLY FOR MATCHING A SATURATION VOLTAGE OF RECHARGEABLE CELLS DURING CHARGING

BACKGROUND OF THE INVENTION (a) Field of the Invention

The present invention relates to a circuit system, and more particularly to a variable resistance linear limit voltage circuit that may, by way of example and not limitation, be used to match the rated saturation voltage VS of different rechargeable cells during charging, and that employs light emitting diodes as both illumination and impedance devices so as to reduce heat generated by the impedance devices while still achieving the desired limit voltage control.

(b) Description of the Prior Art

U.S. Pat. No. 5,118,993 and Europe Patent No. 0487204, both granted to the applicant of the present invention, disclose a multi-voltage output circuit that uses a positive voltage drop from a diode or a zener voltage from a zener diode to control an output voltage supplied to rechargeable cells directly connected in parallel at the output of the multi-voltage output circuit during a charging process, or the positive voltage drop from multiple diodes directly connected in parallel with the cells to provide a limit-voltage-divided charging current. In either application, the circuit provides a regulated voltage V0 when the terminal voltage of the cells accumulates along with the charging current and rises up to such extent close to, and eventually becomes identical with the positive voltage drop value. However, the positive voltage drop of the diodes in such an arrangement has a gradient of approximately 0.7V difference depending on the number of diodes connected in series, and therefore it is very difficult to match the rated saturation voltage VS of the cells by changing the number of diodes connected in series when the positive voltage drop of the diodes connected in parallel is not of the same value as that of the VS. Therefore, diodes must be directly connected in parallel with the cells being charged, and such connection creates the following defects:

1. In the absence of additional connection in series of a proper limiting current, the charging current IB decreases when a composite regulated voltage V0 is generated by the positive voltage drop of the diode and the terminal voltage of the cells. As a result, the diodes are vulnerable to being burnt out due to the significantly increased current passing through the diodes, as illustrated in FIG. 1 of the accompanying drawings of the present invention; and
2. The positive voltage drop value of the diodes is not consistent with the rated saturation voltage VS required by the cells. If the value is lower than VS, the charging current IB passing through the cells gets too small and consequently, the charging process becomes too slow or the charging current is insufficient, as illustrated in FIG. 2. On the other hand, if the value gets higher than VS, the cells will be overcharged.

SUMMARY OF THE INVENTION

The primary purpose of the present invention is to provide a linearly variable resistance limit voltage circuit system including a light emitting display.

The limit voltage circuit of the invention may be used in a variety of applications, one of which is the application of matching the saturation voltage of a rechargeable cell to ensure fully saturated charging, while at the same time preventing damage to the cell due to overcharging, reducing thermal loss from the limit voltage circuit, and providing a light emitting display when required.

DETAILED DESCRIPTION OF THE PREFERRED EMBODIMENTS

To correct defects of the prior art, an impedance Z0 is connected in series with diodes to provide a more advanced function of allowing linear regulation and matching various ratings of saturation voltage VS. When a terminal voltage at a rechargeable cell rises and becomes greater than a positive voltage drop of a diode (or a zener voltage or positive voltage drop of a zener diode), the current passing through the diode (or the zener diode) is further limited by linear regulation. Meanwhile, cells with various ratings of saturated voltage are guaranteed to achieve saturated charging to protect the diode (or the zener diode) connected in parallel with the cells from being damaged by overcharging.

One problem with the use of diodes in this manner is that the resistance usually will transfer electric energy into thermal energy resulting in an overheated circuit. This problem is solved by the direct use of a light emitting diode as a biased illumination and impedance device that is able to transfer certain electrical energy that may be otherwise transferred into thermal energy into optical energy. The thermal energy is thereby reduced while the optical energy can be utilized for display purposes.

In a conventional application having a diode connected in series with both terminals of a cell to function as a limit voltage branch current, both the positive voltage drop across the diode and the cell terminal voltage combine to provide a regulated voltage V0 when the cell is charged to a certain extent. At this time, a charging current IB passes through the diode and cell. If the combined terminal voltage V0 becomes greater than IB, a branch current ICR passing through the diode significantly increases which can cause a number of problems. If the cell is connected in parallel with one or multiple matching diodes connected in series, or an additional zener effect device containing a zener diode is connected in series to serve as an impedance for linear current regulation, a voltage drop is created as a result of the branch current ICR passing through the diode (or the zener effect device). Furthermore, an impedance drop takes place at both terminals of the impedance, and varies depending on the variation of the branch current ICR.

Figure 1:
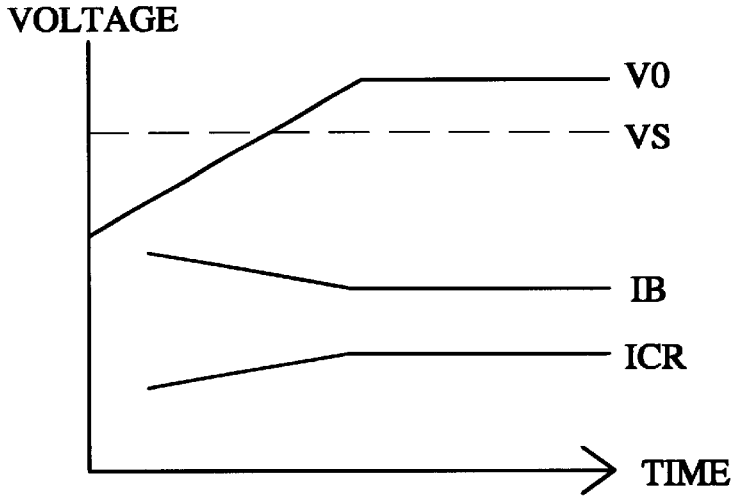
FIG. 1 is a schematic view showing a process of overcharging a cell using a conventional system of diodes directly connected in parallel as a limit voltage.
Figure 2:
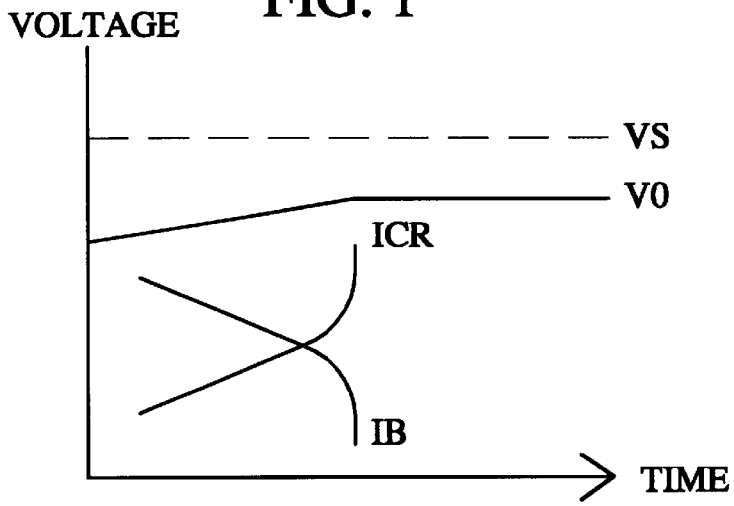
FIG. 2 is a schematic view showing a process of undercharging a cell using a conventional system of diodes directly connected in parallel as a limit voltage.
Figure 3:
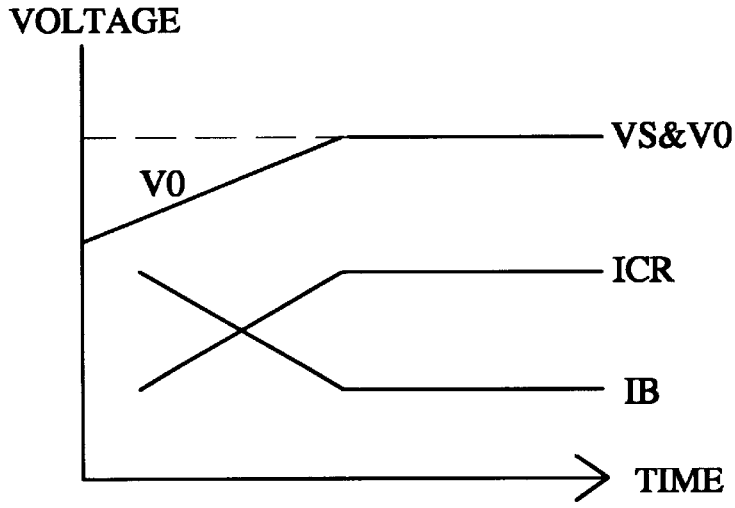
FIG. 3 is a schematic view showing a process of charging a cell for indicating ideal charging characteristics using a conventional system of diodes directly connected in parallel as a limit voltage.

As illustrated in FIG. 3, the impedance drop and the positive voltage drop passing through the diode (or the zener effect device) become aggregated and subject to linear regulation by the branch current to charge the cells and create a combined regulated voltage, with the cells connected in parallel at a value identical to or close to a rated saturation voltage VS of a selected cell. Meanwhile, the current passing through the diode (or the vener effect device) is also subject to linear regulation by the impedance. However, the flaw is that thermal loss occurs as the electrical energy of the impedance device and the diode or the zener device approaches 100%. The significant thermal loss does not provide any other positive function. Furthermore, a similar flaw is also found in other circuit applications that use similar impedance devices.

The light emitting variable resistance linear limit voltage circuit system of the present invention reduces the amount of thermal energy generated during voltage limitation by substituting optical energy, and makes the optical energy available for use in a display as required without compromising its linear limit voltage function. The reduction is achieved by replacing the conventional diode, zener diode or other resistance, or by combining one or more such impedance devices, with one or multiple light emitting diodes having illumination and resistance characteristics and that are connected in series, parallel or a series-parallel combination. As a result, electrical energy is transformed into optical rather than thermal energy. The circuit system of the present invention is applicable to various types of circuits, and is particularly adapted to a rechargeable cell system to assure saturated charging, preventing damage due to overcharging, reducing thermal loss by the limit voltage circuit, and providing a display when required.

Turning to FIGS. 4–15, depending on the polarity of the drop created by a unit LRLV100 of the light emitting variable resistance linear limit voltage circuit system of the present invention, the system is connected either in series or parallel to both terminals of a rechargeable cell unit ESD100 to serve as charging protection, or connected in series or parallel with an electromechanical or solid state switching system or linear control system CU100. Further, the system may be connected in series or parallel to a load.

Figure 4:
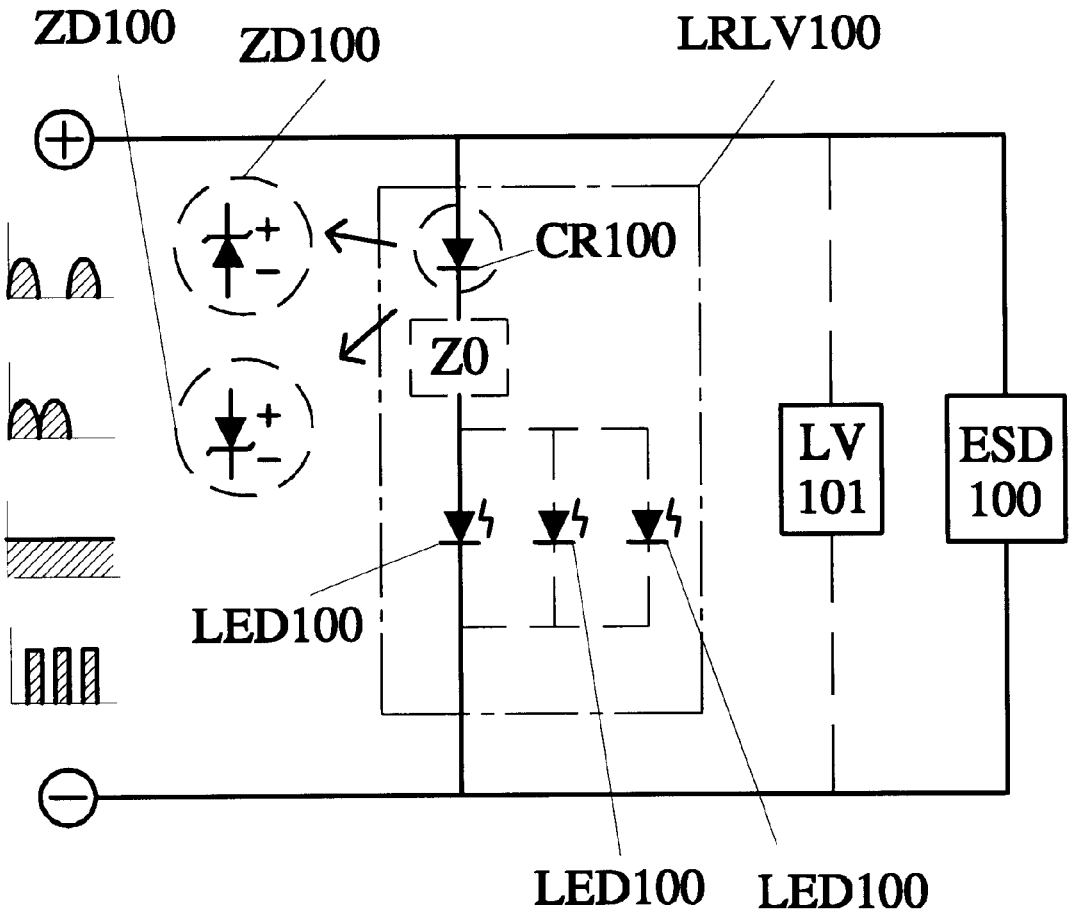
FIG. 4 is a schematic view showing a voltage limiting circuit for a single rechargeable cell according to a preferred embodiment of the invention.
Figure 6:
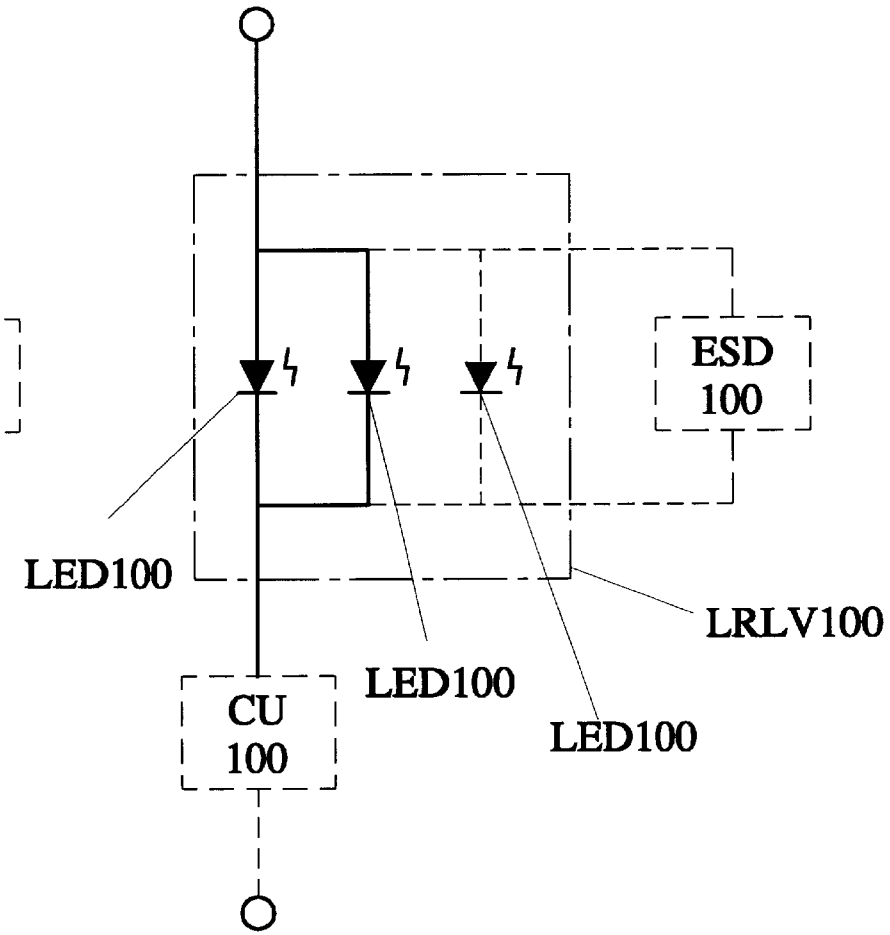
FIG. 6 is a view showing a preferred embodiment of a light emitting variable resistance linear limit voltage system that includes a plurality of light emitting diodes connected in parallel.
Figure 5:
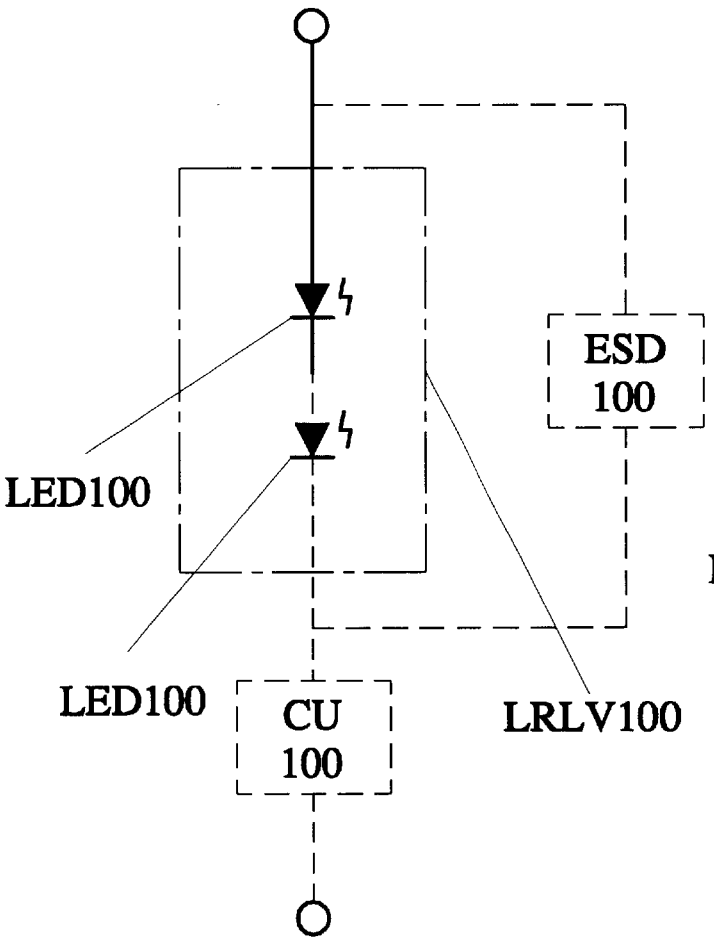
FIG. 5 is a view showing a preferred embodiment of a light emitting variable resistance linear limit voltage system that includes a plurality of light emitting diodes connected in series.
Figure 7:
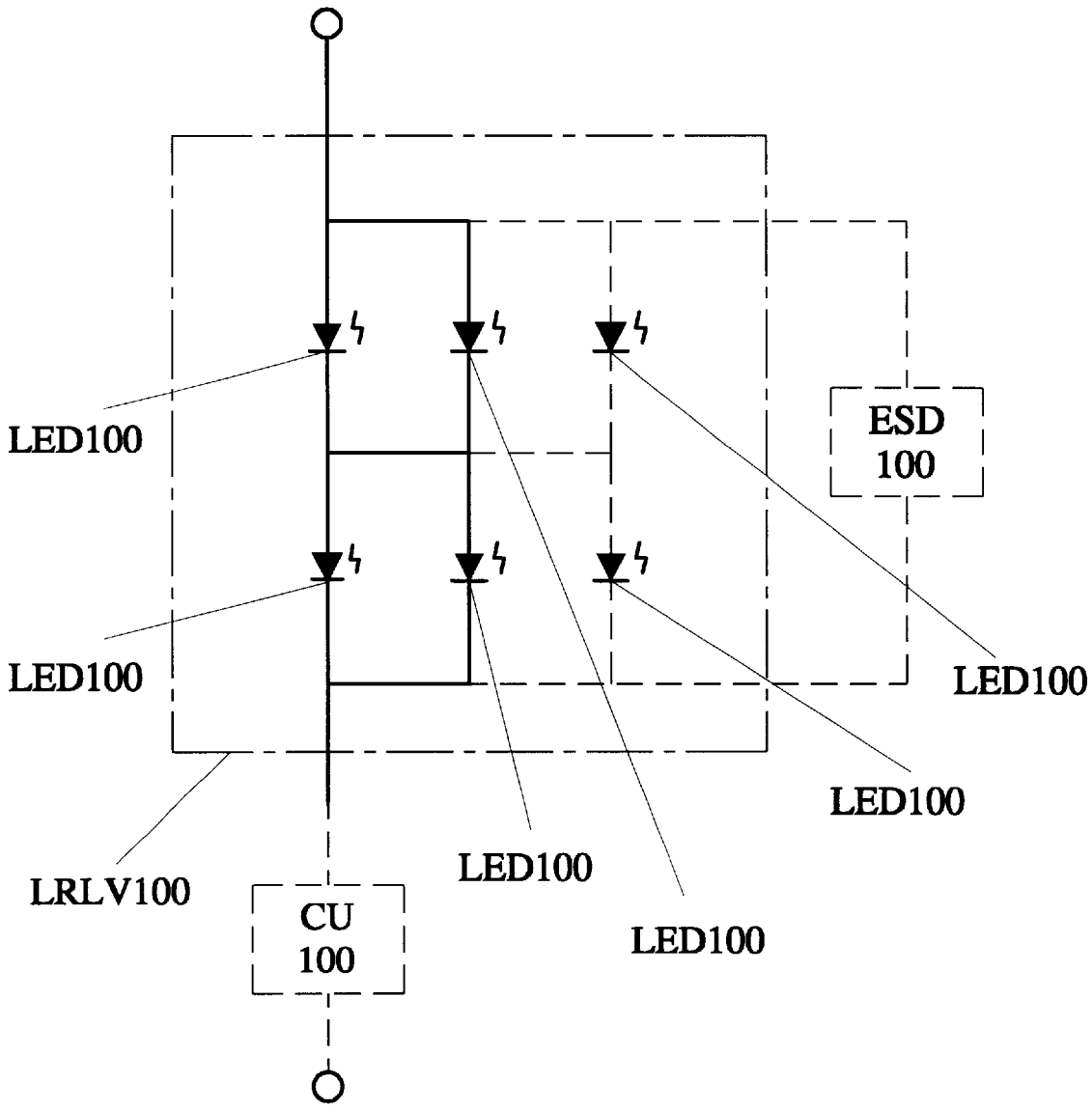
FIG. 7 is a view showing a preferred embodiment of a light emitting variable resistance linear limit voltage system that includes a plurality of light emitting diodes connection in series and parallel.
Figure 10:
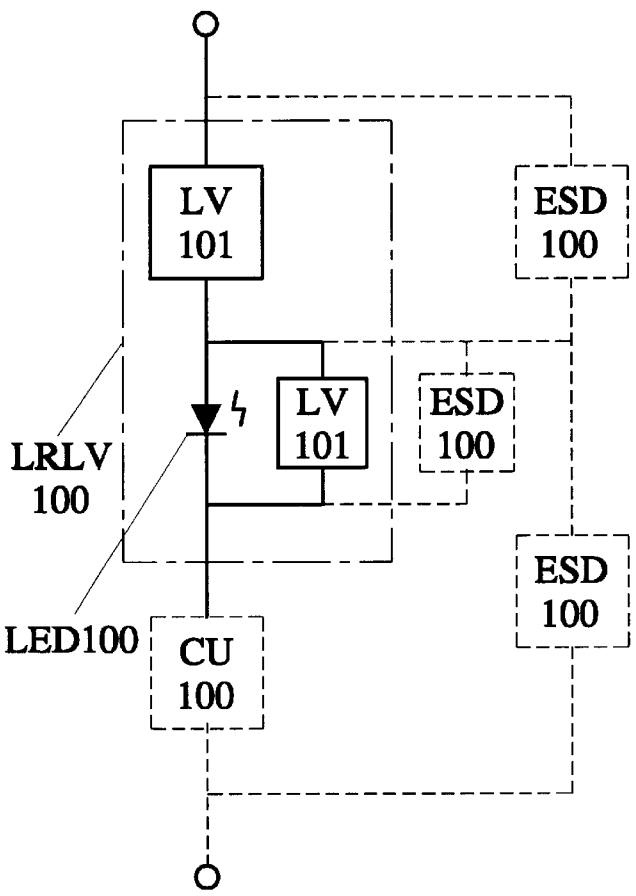
FIG. 10 is a view showing a preferred embodiment of a light emitting variable resistance linear limit voltage system that includes a light emitting diode connected in series and parallel with a limit voltage circuit.
Figure 9:
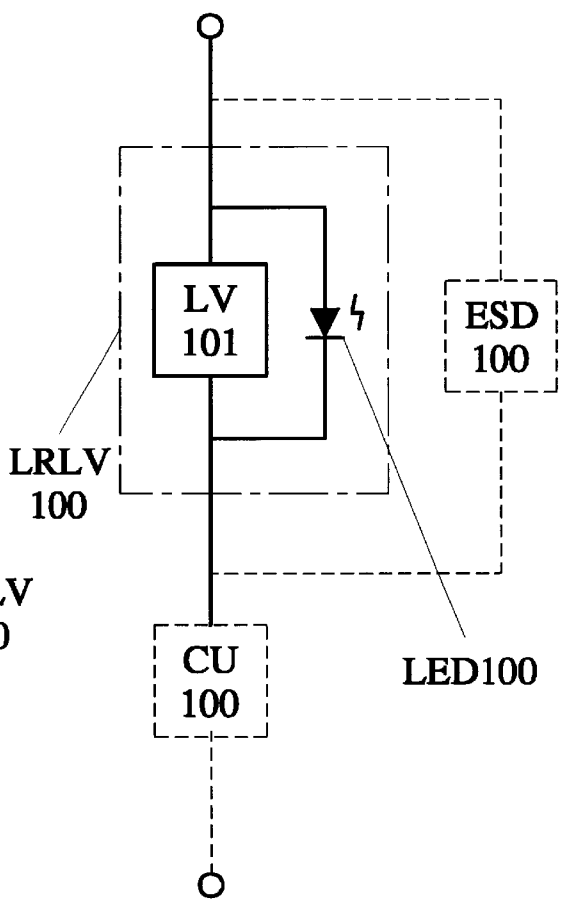
FIG. 9 is a view showing a preferred embodiment of a light emitting variable resistance linear limit voltage system that includes a light emitting diode connected in parallel with a limit voltage circuit.
Figure 8:
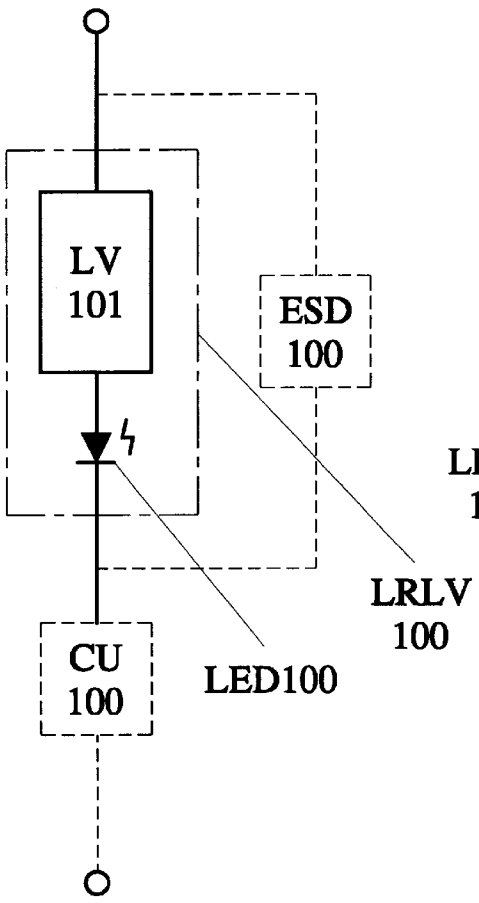
FIG. 8 is a view showing a preferred embodiment of a light emitting variable resistance linear limit voltage system that includes a light emitting diode connected in series with a limit voltage circuit.

FIG. 4 shows a preferred rechargeable cell system that includes a light emitting variable resistance linear limit voltage circuit system LRLV100 in which the light emitting diodes are connected in parallel. FIG. 5 shows a variation of the light emitting variable resistance linear limit voltage circuit system of FIG. 5 in which the light emitting diodes are connected in series, and FIG. 6 shows a variation of the light emitting variable resistance linear limit voltage circuit system in which the light emitting diodes are connected in parallel. FIG. 7 shows a preferred embodiment of a light emitting variable resistance linear limit voltage circuit system in which the light emitting diodes are connected in a series-parallel combination. FIGS. 8–10 respectively show series, parallel, and combined series-parallel combinations of the light emitting diodes LED 100 with other voltage limiting device. The light emitting diodes in each of these embodiments may be in the form of multiple different or same types of light emitting diodes LED 100. In addition, one or multiple rechargeable cells ESD100 are provided as required.

The light emitting variable resistance linear limit voltage circuit system of the embodiments of FIGS. 4–10 is formed by taking advantage of the drop resistance and light emitting features of the light emitting diodes LED 100, optionally combined as indicated below with the positive drop feature or the limit voltage feature of a diode CR100, the positive or reverse zener voltage of a zener diode ZD 100, or the impedance feature of an impedance device connected in series, parallel or series-parallel combination with any of the light emitting diodes LED100.

The rechargeable cell ESD100 of the embodiments illustrated in FIGS. 4–10 may be a Pb, NiH, NiZn, NiCd, NiFe, Li cell comprised of one or multiple cells connected in series, or another types of rechargeable secondary cell, capacitor or super capacitor that matches the light emitting variable resistance linear limit voltage circuit system, LRLV100, in any of the following ways:

(1) Limit voltage circuit system LRLV100 may include one or multiple light emitting diodes LED100 connected in series, parallel or a series-parallel combination, and further connected in parallel to like polarity positive and negative terminals of a rechargeable cell unit ESD100, depending on the selected polarity relation and on the polarity of a voltage drop created when the limit voltage system LRLV100 conducts a branch current; or (2) The rechargeable cell unit ESD100 may be directly connected, or connected via a switch, plug-socket unit, or a terminal to the limit voltage system LRLV100 either in series or parallel depending on the selected polarity relation.

Figure 11:
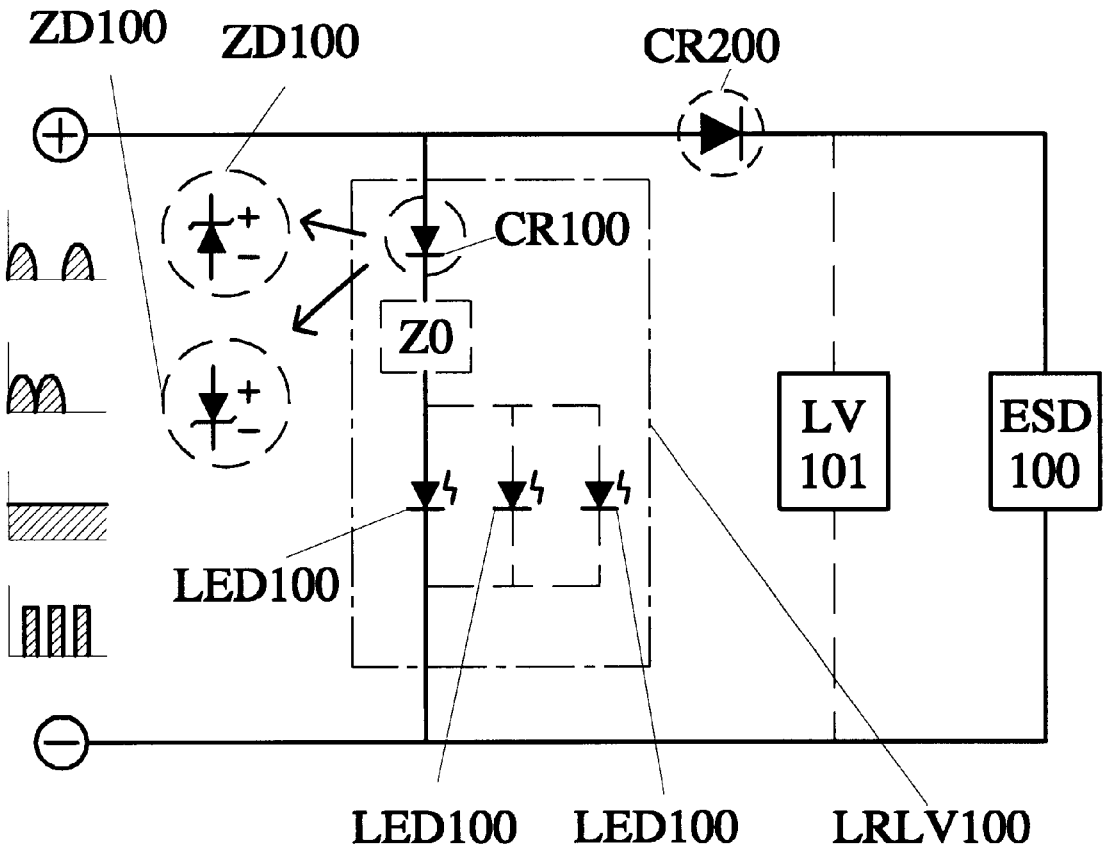
FIG. 11 is a view showing a preferred embodiment of a circuit having additional separation diodes connected in series at an output of the limit circuit of the present invention.

(3) As shown in FIG. 11, a separation diode CR200 (or other device providing unidirectional conduction) may be connected in series along the output direction as desired between the limit voltage circuit system LRLV100 and the rechargeable cell unit connected in parallel with the limit voltage circuit system to prevent discharging in a reverse direction. Depending on the application, the separation diode may also be connected in series with a drop impedance device, or another limit voltage circuit LV101 of any type, or the limit voltage system LRLV100 may be further connected in parallel at the output of the separation diode CR200 before being connected to the rechargeable cell unit ESD100.

Parallel connection of an input of the limit voltage circuit system LRLV100 connected to the rechargeable cell unit as illustrated in FIGS. 4 and 11 allows matched connection to various types of charging circuit system. As a result, after saturated charging, the charging circuit can either be manually cut off, based on detection of the terminal voltage of the cell in the course of charging, or based on the temperature rising effect when the rechargeable cell is saturated. A negative voltage effect detected at the cell when the cell is saturated may serve as a reference for manipulation or circuit break at the time of saturated charging. Furthermore, a timer device may be used to control or cut off charging of the cell, or the charging process may be controlled by other methods of controlling the charging voltage and amperage.

Figure 12:
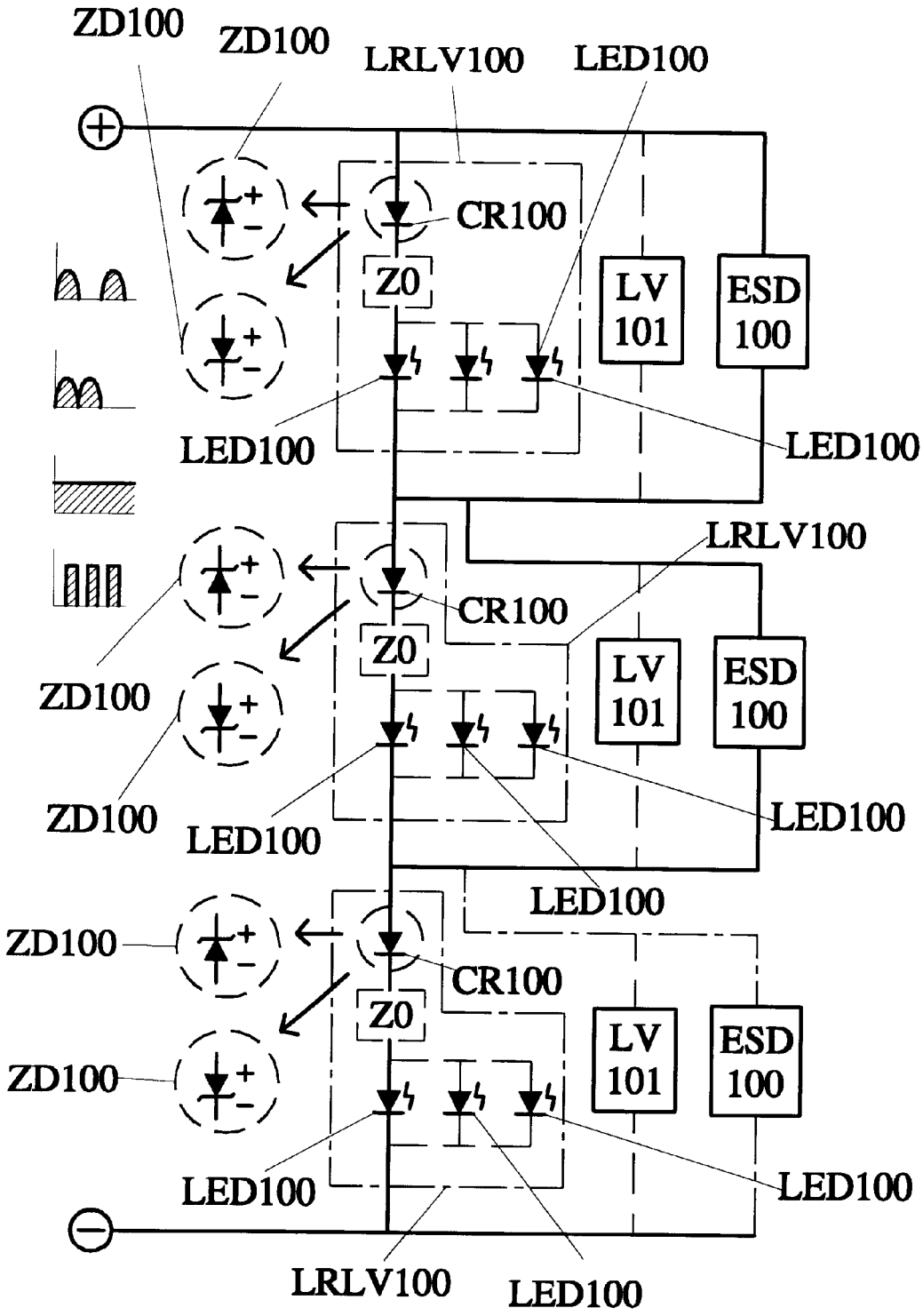
FIG. 12 is a schematic view showing multiple rechargeable cells connected in series to match multiple light emitting variable resistance linear limit voltage circuits also connected in series according to the present invention.

Multiple unit output circuits can be formed based on the limit voltage system LRLV100 by connecting multiple LRLV100 systems of the same polarity in series. FIG. 12 shows a schematic view of a circuit comprised of multiple rechargeable cells connected in series and matched by multiple sets of the limit voltage circuit system also connected in series. The two or more systems LRLV100 having the same polarity may each include one light emitting diode LED100, or multiple light emitting diodes LED100 connected in series, parallel, or a series-parallel combination. Furthermore, as described above, the additional limit voltage circuit LV101 to which the limit voltage circuit LRLV100 may be connected may include at least one diode CR100, at least one positive or reverse zener effect device ZD100 containing a zener diode, at least one impedance device Z0, or any combination of two or more than two of those devices connected in series. Also, depending on the application requirements, multiple connection switches may optionally be provided to respectively connect to both terminals of the rechargeable cell unit ESD100 with the same polarity according to the direction of the branch current passing through the switch.

The rechargeable cell unit ESD100 includes a Pb, NiH, NiZn, NiCd, NiFe, or Li cell comprised of one cell or multiple cells connected in series, or any other type of rechargeable secondary cell, capacitor or super capacitor. The ESD100 may be connected is to the limit voltage circuit system, LRLV100, in any of the following ways:

(1) The limit voltage circuit system LRLV100 may be connected in parallel with the same polarity between the positive and negative terminals of each rechargeable cell unit ESD100;

(2) Depending on the selected polarity relation, each pole of each of a plurality of positive series-connected rechargeable cell units ESD100 may further be connected in parallel with a respective limit voltage circuit system LRLV100 by means of a direct connection, switch, plug-socket unit, or connection terminal.

Each individual output of the series-connected, same polarity limit voltage circuit systems of this embodiment permits individual output for matched connection to a respective rechargeable cell unit ESD100 simultaneously or individually charge the rechargeable cell unit ESD100. Furthermore, the limit voltage circuit system LRLV10 may be connected in series of same polarity to various types of additional limit voltage circuits LV101 made up of a diode CR100, positive or reverse zener diode ZD100, limit impedance device Z0, or any combination of those devices connected in series, parallel or series-parallel, as follows:

(1) Depending on the selected polarity relation, each unit of limit voltage circuit system LRLV100 and the output of each type of additional limit voltage circuit LV101 may be simultaneously connected in parallel to each rechargeable cell unit ESD100.

Figure 13:
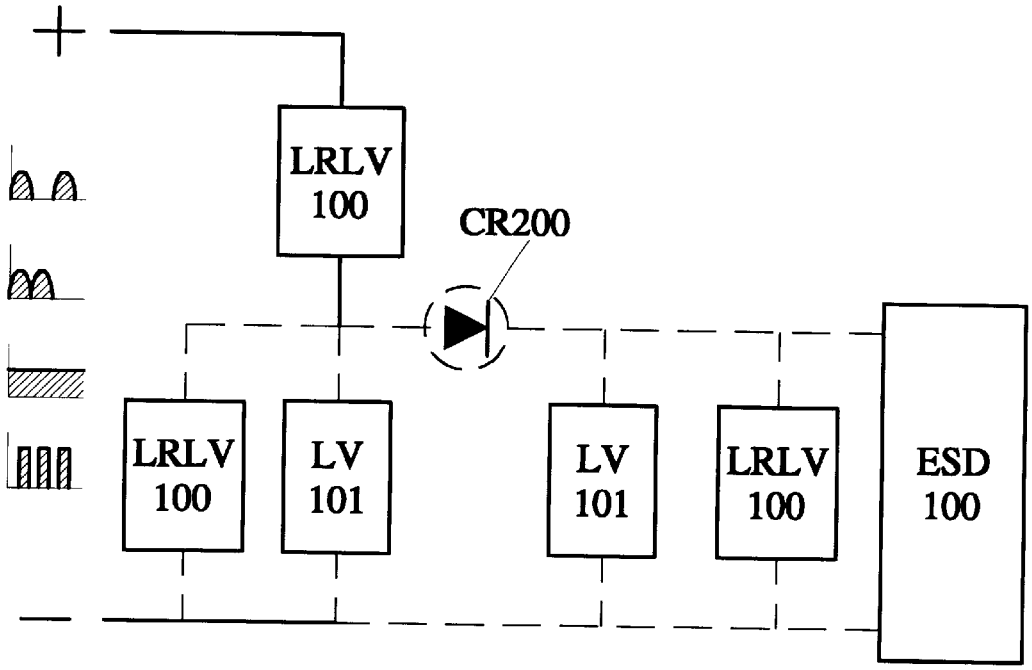
FIG. 13 is a view showing an application of the present invention in which the light emitting variable resistance linear limit voltage circuit is connected in series with a combination of various types of limit voltage circuits.
Figure 14:
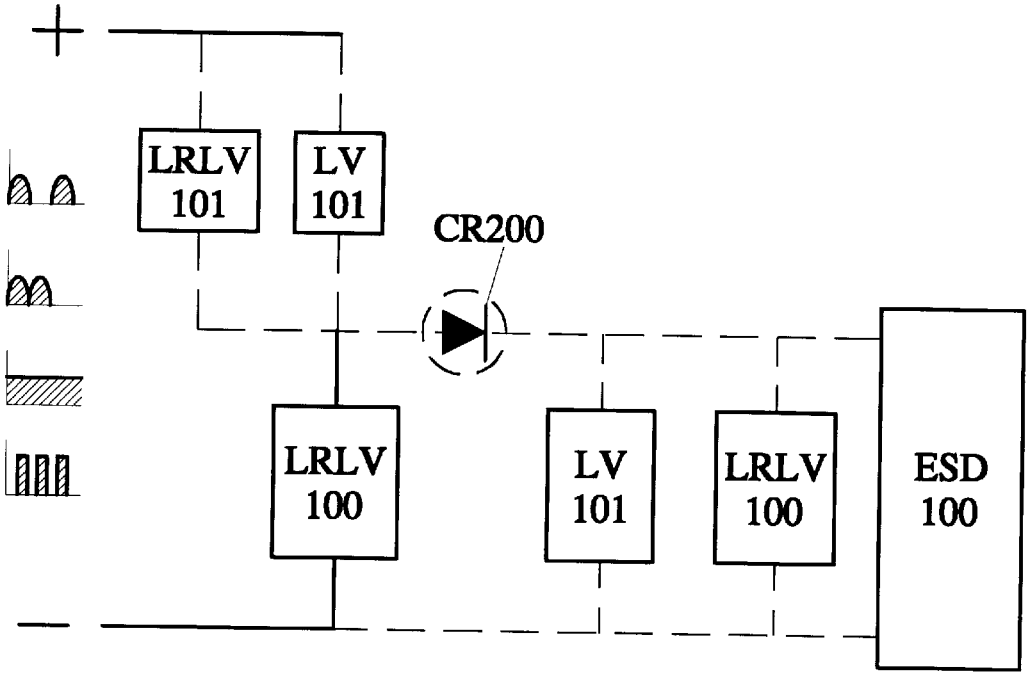
FIG. 14 is a view showing another application of the present invention in which the light emitting variable resistance linear limit voltage circuit is connected in series with a combination of various types of limit voltage circuits.
Figure 15:
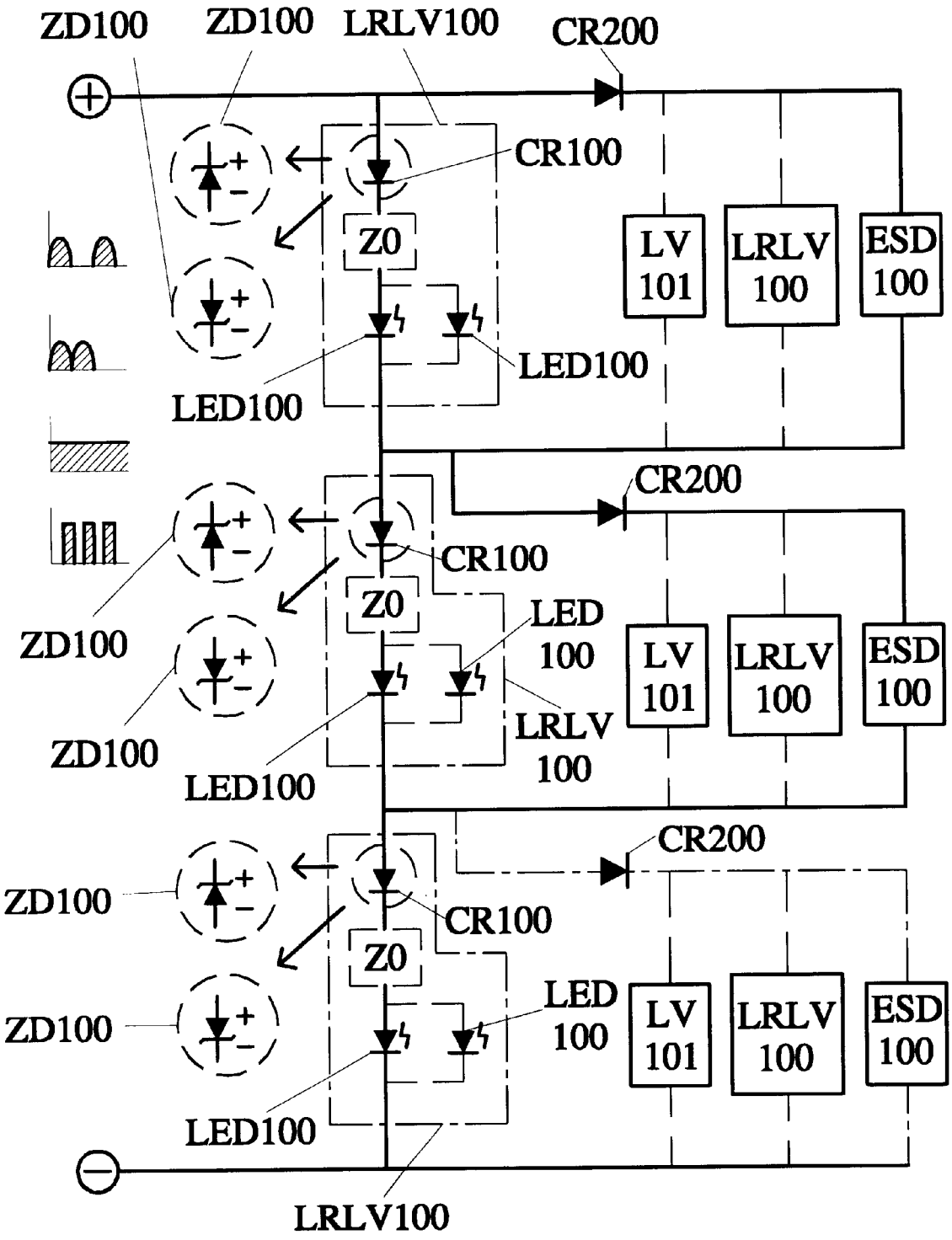
FIG. 15 is a view showing a preferred embodiment of a circuit having additional separation diodes connected in series at each output of the limit voltage circuit of the present invention.

(2) As illustrated in FIG. 13, the preferred limit voltage circuit may be connected in series with a combination of various types of limit voltage circuit, with certain units of the limit voltage circuit system LRLV100 being connected in parallel with the rechargeable cells ESD100. Alternatively, depending on the application requirements, additional types of limit voltage circuit LV101 may be provided and jointly connected in parallel to the rechargeable cells ESD100 to provide a branch voltage, with the remaining units of the light emitting variable resistance being connected in series with the corresponding limit voltage circuit system ESD100 but not connected in parallel with the rechargeable cells to also provide a branch voltage. Furthermore, as may be required by other applications, a separation diode CR200 (or other devices providing unidirectional conduction function) may be provided in series at the output to prevent reverse discharging, as illustrated in FIG. 11. The separation diode may be connected in series with a drop impedance device or the limit voltage system LRLV100, or any type of limit voltage circuit LV101 may be connected in parallel at the loading terminal;

(3) As shown in FIG. 14, the limit voltage circuit system of the present invention may also be connected in series to a combined additional limit voltage circuit, with a portion of certain units of the light emitting variable resistance linear limit voltage system LRLV100 being connected in parallel to a rechargeable cell unit ESD100, while certain units of another portion of the limit voltage system LRLV100 or various types of limit voltage circuit LV101 are connected in series to provide a branch voltage function with respect to those units of the limit voltage system LRLV100 connected in parallel with rechargeable cell ESD100. Alternatively, the branch voltage function may be provided by connecting the limit voltage system LRLV100 in parallel (or in series, or series-parallel) to various types of limit voltage circuit LV101, and then further connecting the limit voltage circuit LV101 in series to those units of light emitting variable resistance linear limit voltage system LRLV100 connected in parallel with rechargeable cell ESD100. Furthermore, as may be required by other applications and as mentioned above with respect to FIG. 13, separation diode CR200 (or other devices providing unidirectional conduction function) may be provided in series at the output to prevent reverse discharging as illustrated in FIG. 11, and/or the separation diode may be connected in series with a drop is impedance device or the limit voltage system LRLV100, or any type of limit voltage circuit LV101 may be connected in parallel at the loading terminal;

(4) Referring to FIG. 15, the above-mentioned separation diode CR200 is connected along the output direction as applicable between each unit of light emitting variable resistance limit voltage system LRLV100 and a corresponding rechargeable cell connected in parallel with each unit of limit voltage system LRLV100. Alternatively, another limit voltage circuit LV101 (or another light emitting limit voltage circuit system LRLV100) may be connected in parallel at the output of the separation diode CR200 to be already separated before reaching the rechargeable cell ESD100.

Connection of the input of the limit voltage circuit system LRLV100 in parallel with the rechargeable cell ESD100, as illustrated in FIGS. 4 and 11~15, permits matched connection to various types of charging circuit systems to charge the rechargeable cell. As a result, after saturated charging, the charging circuit can be either cut off manually, based on the terminal voltage of the cell in the course of charging, or based on the temperature rising effect when the cell is saturated. A negative voltage effect detected at the cell when the cell is saturated may serve as a reference for manipulation or circuit break at the time of saturated charging. Furthermore, a timer device may be used to control or cut off the charging to the cell, or the charging process to the cell may be controlled by other methods of controlling the charging voltage and amperage.

Furthermore, depending on circuit requirements, the light emitting variable resistance linear limit voltage system LRLV100 as well as any additional limit voltage circuit LV101, as illustrated in FIGS. 4 and 11~15 may include one or more light emitting diodes LED100 connected in a series-parallel combination to provide functions of bias and light emitting variable resistance, and the function of simultaneous light emitting display if required. In addition, an impedance device Z0 in the form of a resistive, inductive, or capacitive impedance or a combination of any two or more than two types of resistive, inductive, and/or capacitive impedances may be used in case the DC source input source contains ripple. If required the resistance impedance may include a general resistance, a positive temperature coefficient (PTC) resistance, a negative temperature coefficient (NTC) resistance, or two or more impedances connected in series, parallel or series-parallel. The above-mentioned diode CR100 may again be made of various materials and structures, and may be replaced by other solid state electronic devices capable of creating an equivalent to the positive voltage drop effect of the diode CR100 when current passes through the devices, while zener diode ZD100 may be connected in its positive or negative direction, or be replaced by another solid state electronic device having a zener effect. Separation diode CR200 may similarly be made of various materials and structures, and be replaced by other solid state electronic devices such as a light emitting diode or a zener diode that is equivalent to the rated voltage range and unidirectional separation effect of the separation diode CR200.

To sum up, the light emitting variable resistance linear limit voltage system LRLV100 disclosed in the present invention ensures fully saturated charging of a rechargeable cell ESD100, prevents the rechargeable cell ESD100 from being damaged by overcharging, reduces thermal loss in the limit voltage circuit and offers a light emitting display as required while lowering production cost and providing precise functions.

What is claimed is:

1. In a voltage limiting circuit system, comprising:

a power source;

a load; and a first variable resistance voltage limiting circuit, said variable resistance voltage limiting circuit including at least one voltage limiting diode connected in parallel between the power source and the load and arranged to limit a voltage supplied to the load when the voltage exceeds a predetermined voltage, the improvement wherein said at least one voltage limiting diode is a light emitting diode that turns on, and thereby converts power from the power source into light, when the voltage exceeds the predetermined voltage, whereby heat generated by said at least one voltage limiting diode is minimized because the power from the power source is converted to light instead of heat, and whereby said at least one voltage limiting diode serves as both a voltage limiter and a display element.

2. A voltage limiting circuit system as claimed in claim 1, wherein said load is a rechargeable battery, and said predetermined voltage is a saturation voltage of the rechargeable battery.

3. A voltage limiting circuit system as claimed in claim 1, wherein said variable resistance voltage limiting circuit includes a plurality of light emitting diodes connected in series.

4. A voltage limiting circuit system as claimed in claim 1, wherein said variable resistance voltage limiting circuit includes a plurality of light emitting diodes connected in parallel.

5. A voltage limiting circuit system as claimed in claim 1, wherein said variable resistance voltage limiting circuit includes a combination of series and parallel connected light emitting diodes.

6. A voltage limiting circuit system as claimed in claim 1, wherein said variable resistance voltage limiting circuit further includes at least one diode connected in series with the at least one light emitting diode.

7. A voltage limiting circuit system as claimed in claim 1, wherein said variable resistance voltage limiting circuit further includes at least one diode connected in series between said power source and a plurality of light emitting diodes.

8. A voltage limiting circuit system as claimed in claim 1, wherein said variable resistance voltage limiting circuit further includes at least one zener diode connected in series with the at least one light emitting diode.

9. A voltage limiting circuit system as claimed in claim 1, wherein said variable resistance voltage limiting circuit further includes at least one zener diode connected in series with a plurality of light emitting diodes.

10. A voltage limiting circuit system as claimed in claim 1, wherein said variable resistance voltage limiting circuit further includes at least one impedance device connected in series with said at least one light emitting diode.

11. A voltage limiting circuit system as claimed in claim 1, wherein said variable resistance voltage limiting circuit further includes at least one impedance device connected in series with a plurality of said light emitting diodes.

12. A voltage limiting circuit system as claimed in claim 1, further comprising an additional voltage limiting circuit connected in parallel between said variable resistance voltage limiting circuit and said load.

13. A voltage limiting circuit system as claimed in claim 1, further comprising an additional voltage limiting device connected in series with said at least one light emitting diode.

14. A voltage limiting circuit system as claimed in claim 1, further comprising an additional voltage limiting device connected in parallel between end terminals of said at least one light emitting diode.

15. A voltage limiting circuit system as claimed in claim 1, further comprising an additional voltage limiting device connected in parallel between end terminals of said at least one light emitting diode, and an additional voltage limiting device connected in series with said at least one light emitting diode.

16. A voltage limiting circuit system as claimed in claim 1, further comprising a switching control system for further limiting supply of power to said load.

17. A voltage limiting circuit system as claimed in claim 1, further comprising an isolating diode connected in series between said variable resistance voltage limiting circuit and said load.

18. A voltage limiting circuit system as claimed in claim 1, further comprising at least one additional said variable resistance voltage limiting circuit connected in series with said first variable resistance voltage limiting circuit, and wherein said load includes a rechargeable battery connected in parallel with each said variable resistance voltage limiting circuit.

19. A voltage limiting circuit system as claimed in claim 1, further comprising at least one second variable resistance voltage limiting circuit connected in parallel with said first variable resistance voltage limiting circuit.

20. A voltage limiting circuit system as claimed in claim 19, further comprising at least one additional voltage limiting circuit connected in parallel with said first and second variable resistance voltage limiting circuits.

21. A voltage limiting circuit system as claimed in claim 1, further comprising at least one second variable resistance voltage limiting circuit connected in series with said first variable resistance voltage limiting circuit.

22. A voltage limiting circuit system as claimed in claim 19, further comprising at least one additional voltage limiting circuit connected in parallel with said first and second variable resistance voltage limiting circuit.

23. A voltage limiting circuit system as claimed in claim 1, further comprising at least one second variable resistance voltage limiting circuit connected in parallel with said first variable resistance voltage limiting circuit, and at least one third variable resistance voltage limiting circuit connected in series with said first and second variable resistance voltage limiting circuits.

* * * * *